United States Patent [19]

Spercel

[11] 4,014,239

[45] Mar. 29, 1977

[54] GUITAR STRING TUNING DEVICE

[76] Inventor: Robert J. Spercel, 3214 W. 139th St., Cleveland, Ohio 44120

[22] Filed: Mar. 12, 1975

[21] Appl. No.: 557,817

[52] U.S. Cl. ..... 84/306

[51] Int. Cl.[2] ..... G10D 3/14

[58] Field of Search ..... 84/267, 297, 304–306; 74/409

[56] References Cited

UNITED STATES PATENTS

| | | | |
|---|---|---|---|
| 310,590 | 1/1885 | Hyde | 84/306 |
| 516,545 | 3/1894 | Murdock | 84/306 |
| 895,210 | 8/1908 | Standing | 84/306 |
| 1,367,105 | 2/1921 | Stromberg | 84/306 |
| 1,452,075 | 4/1923 | Hammer | 84/306 |
| 1,710,802 | 4/1929 | Page | 84/305 |
| 2,128,460 | 8/1938 | Harlin | 84/306 X |
| 3,220,277 | 11/1965 | Dixon | 74/409 X |
| 3,564,573 | 2/1971 | Wustl | 84/306 |
| 3,888,134 | 6/1975 | Miranda | 74/409 X |

FOREIGN PATENTS OR APPLICATIONS

| | | | |
|---|---|---|---|
| 256,329 | 12/1964 | Australia | 84/267 |

*Primary Examiner*—John Gonzales

[57] ABSTRACT

An improved device for tuning a string of a musical instrument includes a rotatable shaft having one end connected with the string. A pinion gear is connected with the opposite end of the shaft and is disposed in meshing engagement with a worm. A handle is provided to rotate th worm about its central axis to effect rotation of the pinion gear and shaft with a resulting loosening or tightening of the string. An adjustment member is provided to vary the meshing relationship between the worm and pinion gear to eliminate backlash and obtain a desired pressure relationship between the gear teeth. In one embodiment of the invention, the adjustment member is effective to shift the pinion gear relative to the worm. In another embodiment of the invention, the adjustment member is effective to shift the worm relative to the pinion gear. In either embodiment of the invention, once the desired meshing relationship has been obtained between the tow gears, the adjustment member holds the gears against shifting movement relative to each other. Although the adjustment member could take many different forms, in the illustrated embodiments of the invention the adjustment member is provided with an eccentric surface which, upon rotation of the adjustment member, moves the associated one of the two gears.

29 Claims, 13 Drawing Figures

FIG. 1
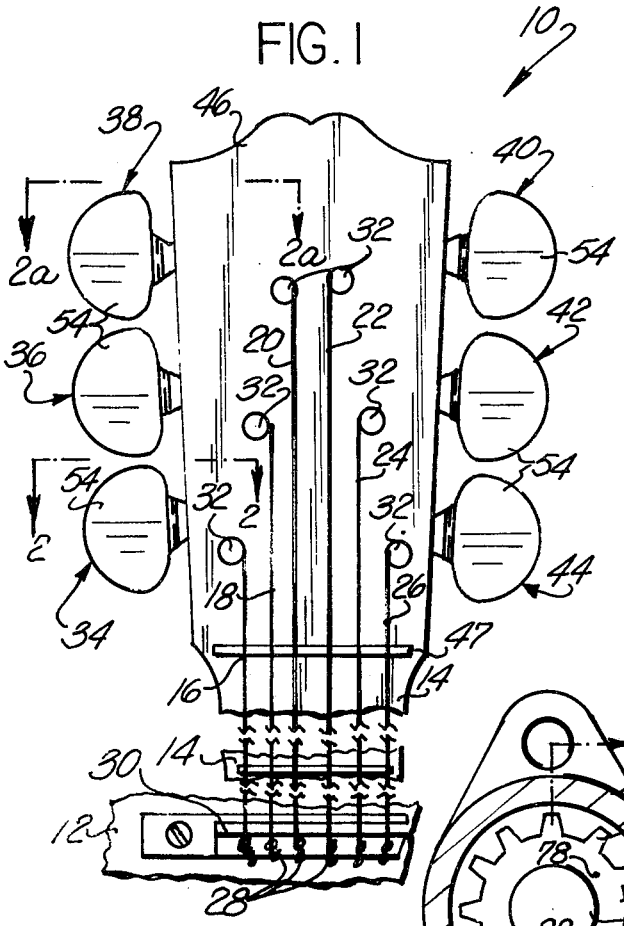
FIG. 2
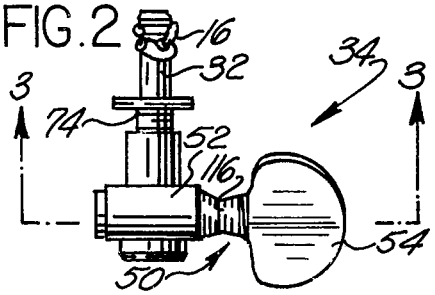
FIG. 2a
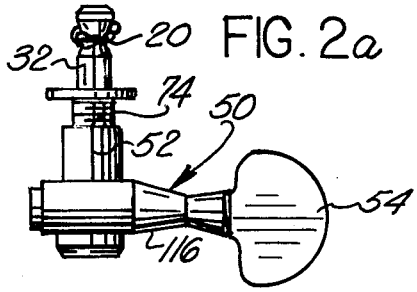
FIG. 3
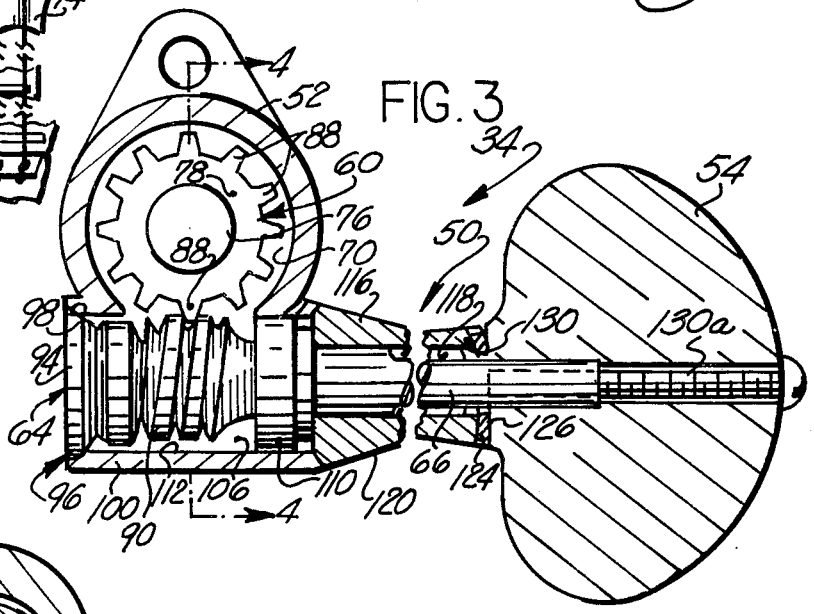
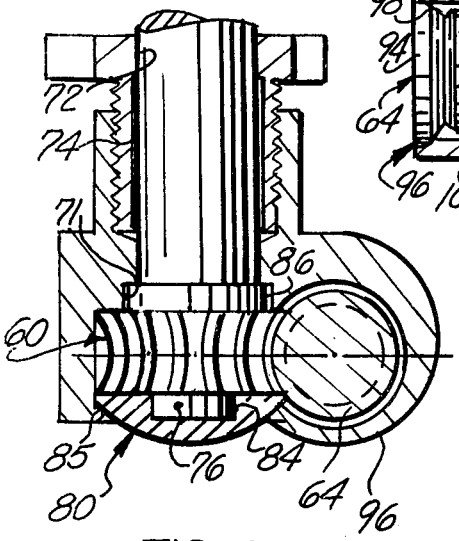
FIG. 4
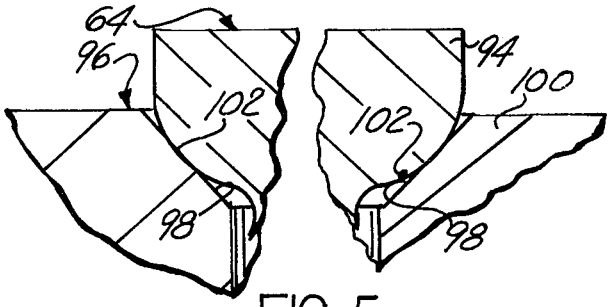
FIG. 5

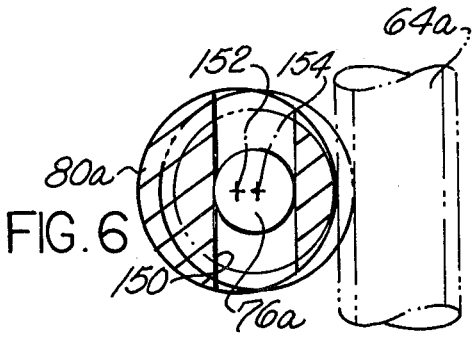
FIG. 6
FIG. 7
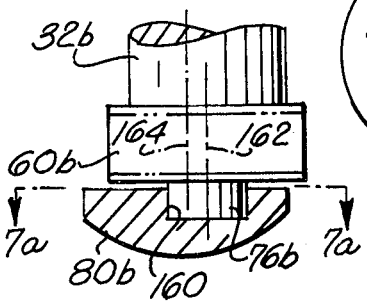
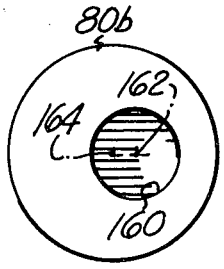
FIG. 7a
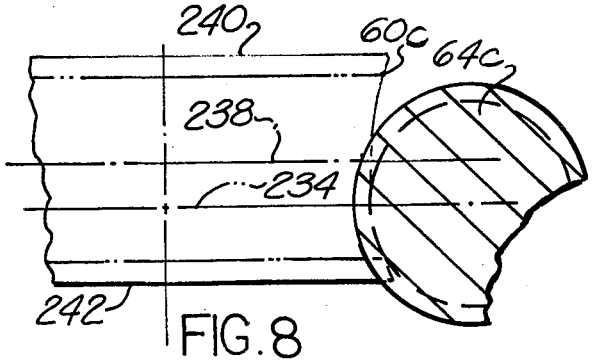
FIG. 8
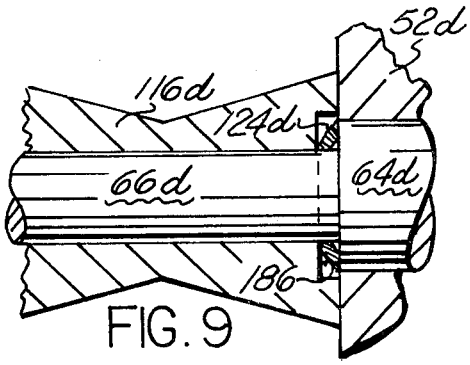
FIG. 9
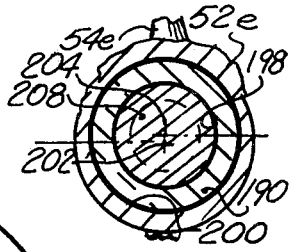
FIG. 11
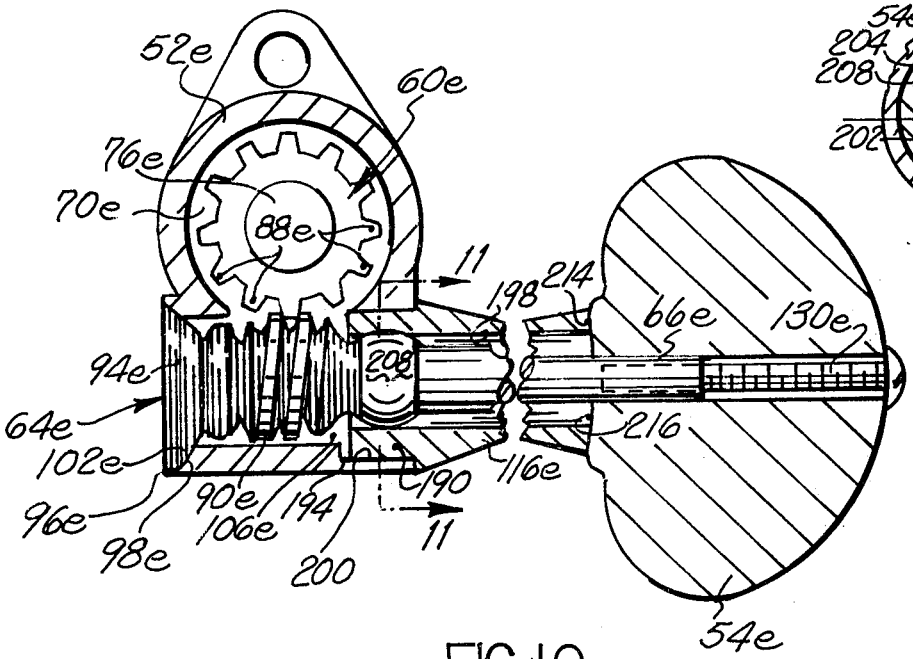
FIG. 10

GUITAR STRING TUNING DEVICE

BACKGROUND OF THE INVENTION

This invention relates generally to a tuning device and more specifically to a tuning device having a pinion gear which is rotated by a worm to vary the tension in a string of a musical instrument.

There are many known tuning devices of the worm and pinion type for varying the tension in the string of a musical instrument. Some of these known tuning devices are disclosed in U.S. Pat. Nos. 3,564,573 and 2,356,766. The desirability of eliminating backlash between the worm and pinion gear of tuning devices has been recognized. Although backlash could be eliminated by merely providing extremely tight meshing engagement between the worm and pinion gear, this is unsatisfactory since it results in a tendency for the gears to jam and is detrimental to sensitivity of tuning. On the other hand if the worm and pinion gear are not disposed in a sufficiently tight meshing engagement, excessive backlash will be present and will impede the tuning of the strings of the instrument. Although the desired meshing relationship between the worm and pinion gear could be obtained by very accurate machining of the gears and their mountings, the cost of this machining is excessive and is therefore not commercially practical. Difficulty has also been encountered with prior art tensioning devices due to a lack of proper alignment and/or support of either or both of the gears.

SUMMARY OF THE PRESENT INVENTION

The present invention provides a new and improved tuning device having an adjustment member which is movable to obtain a desired meshing relationship between worm and pinion gear. Once the desired meshing relationship has been obtained, the adjustment member holds the worm and pinion gear in this desired meshing relationship during subsequent operation of the tuning device. In one embodiment of the invention the adjustment member is an eccentric which is effective to move a pinion gear toward and away from the worm to thereby vary the meshing relationship between the worm and pinion gear. In another embodiment of the device, the adjustment member is an eccentric which is effective to move the worm toward and away from the pinion gear to thereby vary the meshing relationship between the pinion and worm gear. In both of these embodiments, the adjustment member is effective to maintain a substantially constant meshing relationship between the pinion and worm gear during subsequent operation of the tuning device.

The present invention also provides an improved support for the pinion gear. This improved support is accomplished by providing a bearing projection between a side of the pinion gear opposite from the tuning post and a recess in a housing cap. This pinion gear mounting arrangement may be utilized in conjunction with or separate from an adjustment member which varies the meshing relationship between the worm and pinion.

The present invention also provides an improved worm mounting arrangement. This improved mounting arrangement includes surfaces having different curvatures. Due to the interaction between the curved surfaces, the worm is free to move into a properly aligned position and annular line of bearing contact is maintained during operation of the tuning device.

Although tuning devices constructed in accordance with the present invention can be utilized in many different types of stringed instruments, the tuning device is advantageously utilized in association with a stringed instrument in which the shafts or posts of the tuning devices are positioned so that the strings remain parallel to each other. This eliminates binding of the strings in the notches or grooves of the nut on the neck of the musical instrument. By eliminating any tendency for the strings to bind up or catch in the notches of the nut, tuning ability is improved.

Accordingly, it is an object of this invention to provide a new and improved tuning device which includes a worm and pinion gear for rotating a post connected with the string of an instrument and wherein the meshing relationship between the gears can be accurately adjusted and maintained.

Another object of this invention is to provide a new and improved tuning device for use in association with a stringed instrument and wherein an adjustment member is operable to move a pinion gear toward and away from a worm to adjust the meshing relationship between the gears.

Another object of this device is to provide a new and improved tuning device for use in association with a stringed instrument and wherein an adjustment member is operable to move a worm toward and away from a pinion gear to adjust the meshing relationship between the gears.

Another object of this invention is to provide a new and improved tuning device having a pinion gear with a tuning post connected to one side of a body of the gear and a bearing projection formed on the other side of the body of the gear to provide solid rotational support for the pinion gear.

Another object of this invention is to provide a new and improved tuning device having a worm mounting arrangement which facilitates moving the worm into a properly aligned position and which maintains an annular line of contact between a pair of bearing surfaces which rotatably support the worm.

Another object of this invention is to provide a new and improved musical instrument having a plurality worm and pinion type tuning devices which enable a plurality of associated strings to remain parallel outwardly of the nut on the neck of the instrument.

BRIEF DESCRIPTION OF THE DRAWINGS

The foregoing and other objects and features of the present invention will become more apparent upon a consideration of the following description taken in connection with the accompanying drawings wherein:

FIG. 1 is a fragmentary illustration of a stringed musical instrument having parallel strings and tuning devices constructed in accordance with the present invention;

FIG. 2 is an elevational view taken generally along the line 2—2 of FIG. 1, illustrating the construction of one of the tuning devices, the associated portion of the instrument being omitted for purposes of clarity of illustration;

FIG. 2*a* is an elevational view, taken generally along the line 2—2 of FIG. 1 and illustrating the construction of a second tuning device, the associated portion of the instrument being omitted for purposes of clarity of illustration;

FIG. 3 is a sectional view, taken on an enlarged scale taken along the line 3—3 of FIG. 2, illustrating the relationship between a worm and pinion gear of the tuning device;

FIG. 4 is a schematic illustration, taken generally along the line 4—4 of FIG. 3, further illustrating the relationship between the worm and pinion gear;

FIG. 5 is an enlarged fragmentary schematic illustration depicting an improved mounting arrangement for one end portion of the worm of FIG. 3;

FIG. 6 is a schematic illustration of a second embodiment of the invention in which an eccentric slot is provided in a housing cap to adjust the position of a pinion gear relative to a worm;

FIG. 7 is a schematic illustration of another embodiment of the invention in which a housing cap having an eccentric recess is provided to adjust the position of a pinion gear relative to a worm;

FIG. 7*a* is a plan view, taken generally along the line 7*a*—7*a* of FIG. 7 and illustrating the location of the eccentric recess in the cap;

FIG. 8 is a schematic illustration of another embodiment of the invention in which the pinion gear is provided with curved crests and has a central axis which is offset from the central axis of the worm to facilitate the obtaining of firm meshing engagement between the gears;

FIG. 9 is a fragmentary sectional view of an embodiment of the invention in which a tension adjustment washer is disposed between a spacer and one end of the worm;

FIG. 10 is an enlarged sectional view, generally similar to FIG. 3, illustrating an embodiment of the invention in which the worm is movable toward and away from the pinion gear to adjust the meshing relationship between these gears; and FIG. 11 is a sectional view, taken generally along the line 11—11 of FIG. 10, illustrating the relationship between an eccentric adjusting member and one end of the worm gear.

DESCRIPTION OF SPECIFIC PREFERRED EMDODIMENTS OF THE INVENTION

General Description of the Construction of the Stringed Instrument and Tuning Devices An improved stringed musical instrument 10, such as a guitar, includes a body 12 to which there is connected an elongated outwardly extending neck portion 14. A plurality of parallel strings 16 through 26 extend from connections 28 with the body 12 of the guitar, over a bridge 30 and into engagement with posts or shafts 32 of tuning devices or machines 34 through 44 connected with the head end 46 of the guitar. The tuning devices 34–44 are all of the same general construction and are individually operable to tune the associated string by varying the tension in the string.

In order to promote accurate tuning of the strings 16–26 upon operation of the associated one of the tuning devices 34–44, the strings extend parallel to each other between the tuning posts or shafts 32 and a nut 47 on the neck 14 of the guitar. With many known guitars, the strings extend parallel to each other up to the nut and are then deflected sideways to posts or shafts of the associated tuning devices in the manner illustrated in U.S. Pat. No. 2,356,766. In order to hold the strings in position on the outermost nut of the guitar and isolate them from the tuning devices, this nut is provided with notches or grooves through which the strings pass. It has been found that the strings tend to bind in the notches in such a manner as to interfere with tuning of the strings upon operation of the associated tuning devices.

In accordance with one of the features of the present invention, the posts or shafts 32 of the tuning devices 34–44 are positioned so that the portion of the strings extending between the tuning posts 32 and the connections 28 with the body of guitar 12 lay in flat parallel planes. Thus the strings extend along a straight line, at least as is viewed in FIG. 1, from the connections 28 to the posts or shafts 32. This eliminates binding of the strings in the notches in the nut 47. Of course, eliminating binding in the notches or grooves in the nut 47 facilitates accurate tuning of the strings 16–26.

In order to provide for parallel strings between the nut 47 and the tuning devices 34–44, it is necessary to vary the distance which the posts or shafts 32 of the tuning devices 34–44 are disposed inwardly from the side of the guitar. Thus, the posts 32 of the tuning devices 34 and 44 are associated with the two outer strings 16 and 26 and are disposed relatively short distances inwardly from the side of the guitar head 46. The next two posts 32 of the tuning devices 36 and 42 are disposed somewhat further in from the side of the guitar head 46 since the two strings 18 and 24 with which these posts are associated are disposed inwardly of the two outer strings 16 and 26. The shafts 32 of the tuning devices 38 and 40 are disposed still further inwardly since the strings 20 and 22 are the innermost strings. It should be noted that if the posts 32 of the tuning devices 34–44 were all disposed the same distance from the side of the head of the guitar in the manner disclosed in U.S. Pat. No. 2,356,766, the strings would not extend parallel to each other from the nut 47 and the nut notches would interfere with tuning the strings.

In order to provide for the different spacing of the posts 32 from the side of the head 46 of the guitar 10, the tuning devices 34–44 are provided with actuator or handle assemblies 50 (FIGS. 2 and 2*a*) of a length which corresponds to the spacing of the associated string from the side of the guitar. Thus, the tuning device 34 (FIG. 2) has a relatively short handle or actuator assembly 50 which extends outwardly from a housing 52 which is fixedly connected with the head 46 of the guitar. A manually engageable handle 54 of the actuator assembly 50 is disposed immediately adjacent to the side of the head of the guitar in the usual manner.

The post 32 of the tuning device 38 is disposed further in from the side of the head of the guitar since the associated string 20 is disposed inwardly of the string 16. Therefore, the tuning device 38 has a relatively long handle or actuator assembly 50 (FIG. 2*a*) which extends outwardly from the housing 52. The relatively long actuator assembly 50 of the tuning device 38 enables the housing 52 and tuning post 32 to be mounted on the head 46 inwardly of the housing and post 32 of the tuning device 34 while still enabling the handle 54 to be disposed adjacent to the side of the guitar head 46. Of course, the extent to which the actuator assembly 50 extends outwardly from a housing 52 will depend upon the distance from the side of the guitar head 46 to the associated string and will vary with variations in this distance.

Construction of the Tuning Device of FIGS. 3–5

The tuning device 34 includes a pinion gear 60 (FIG. 3) which is fixedly connected to an upright tuning post or shaft 32. A worm 64 is disposed in meshing engagement with the pinion gear 60 and has an outwardly projecting actuator shaft 66 which is connected with the handle 54. Upon rotation of the handle 54, the worm 64 is rotated about its central axis to effect rotation of the pinion gear 60 and tuning shaft or post 32 to vary the tension in the associated string 16.

In accordance with one of the features of the present invention, the pinion gear 60 is firmly supported in a cylindrical gear chamber 70 (FIG. 3) by coaxial bearing surfaces on opposite sides of the gear. Thus, the shaft side of the pinion gear 60 is supported by an annular bearing surface 71 (FIG. 4) on the housing 52 and an annular bearing surface 72 on threaded mounting sleeve 74. A cylindrical bearing projection 76 is formed on the opposite side of the pinion gear body 78 from the post 32 (see FIGS. 3 and 4). The cylindrical projection 76 is disposed in a coaxial relationship with the cylindrical post or shaft 32 and is supported by a housing cap 80. The housing cap 80 has a cylindrical recess 84 which receives the cylindrical bearing projection 76. The cylindrical recess 84, bearing projection 76, spur gear 60, bearing surfaces 71 and 72, and shaft 32 are all disposed in a coaxial relationship. The housing cap 80 is fixedly secured in a circular opening to the gear chamber 70 and is held against axial and sidewise movement by the housing 52. Therefore, the housing cap 84 provides a solid bearing surface for rotatably supporting the spur gear 60. The circular inner surface 85 of the cap 80 is disposed in a coaxial relationship with the recess 84 and cooperates with an annular housing bearing surface 86 to hold the pinion gear 60 against axial movement.

By providing two solid bearing surfaces for opposite sides of the gear 60, that is the bearing surfaces 71 and 72 and the bearing surface provided by the cylindrical sidewall of the recess 84 in the housing cap 80, the pinion gear is held against sidewise movement relative to the worm 64 under the influence of reaction forces between the annular array of teeth 88 on the pinion gear 60 and the helix 90 of the worm.

In a known tuning device, the pinion gear 60 is supported on only one side by a cylindrical shaft sleeve similar to the sleeve 72 and a housing bearing. The opposite side of the known pinion gear merely abuts against a housing cap and is not rotatably supported by a bearing surface in the housing cap. Therefore in this known tuning device reaction forces between the teeth of the pinion gear and the helix of the worm tends to move or tilt the tuning post or shaft. Of course, tilting movement of the tuning post or shaft is detrimental to smooth operation of the tuning device and accurate tuning of the associated string. By providing a solid support on both sides of the pinion gear 60, that is the bearing surfaces 71 and 72 and the cap recess 84, the present invention tends to minimize tilting movement of the pinion gear 60.

In accordance with another of the features of the present invention, the worm 64 is mounted in such a manner that it becomes properly aligned even when there are inaccuracies in casting or machining of the housing 52. Thus, the left end portion 94 (see FIG. 3) of the worm 64 is provided with a positively aligning mounting arrangement 96 which is illustrated schematically in FIG. 5.

The positively aligning mounting arrangement 96 includes a frustroconical bearing surface 98 formed in a circular end of a housing wall 100. The end portion 94 of the worm gear 64 has an arcuate bearing surface 102 which circumscribes the end 94 of the worm gear 64. Due to the different curvatures of the bearing surfaces 98 and 102, the arcuate bearing surface 102 has an annular line of contact with the housing bearing surface 98. Due to the arcuate configuration of the bearing surface 102, if the housing bearing surface 98 is slightly offset from the ideal design position due to machining tolerances or other reasons, the worm 64 can pivot at the mounting 96 to become aligned with the central axis of the worm gear chamber 106. The annular line of contact between the bearing surface 102 and the sloping housing bearing surface 98 is maintained even though the central axis of the worm gear 64 may be tilted slightly relative to the central axis of the gear chamber 106.

By providing the bearing arrangement 96 with substantially line contact between the bearing surfaces 98 and 102, rotation of the worm 64 is promoted and interference between the bearing surfaces, due to burrs or variations in the configuration of the bearing surfaces, is substantially eliminated. This promotes free turning of the worm and accurate tensioning of the string associated with the tuning device 34. It should be noted that this annular line of bearing contact is maintained when the worm 64 is subjected to sidewise gear reaction forces. Of course, the bearing surfaces 98 and 102 could have curvatures different from the illustrated curvatures.

In addition to the support arrangement 96, the worm gear 64 is supported in the housing 52 by a cylindrical bearing section 110. The bearing section 110 engages the cylindrical inner surface 112 of the chamber wall 100. Upon rotation of the handle 54, the reaction forces between the pinion gear 60 and worm 64 are transmitted to the housing 52 by the cylindrical bearing section 110 and the mounting arrangement 96. Due to the annular line of contact which circumscribes the end portion 94 of the worm 64 at the bearing surfaces 98 and 102, the worm 64 maintains its properly aligned orientation when subjected to gear reaction forces.

Although the bearing section 110 has a cylindrical configuration in the embodiment of the invention illustrated in FIG. 3, it is contemplated that the bearing section could advantageously be formed with an arcuate outer surface so as to have annular line of contact with the inner surface 112 of the housing 52. By forming the bearing section 110 with an arcuate outer surface, rather than the cylindrical outer surface illustrated in FIG. 3, the aligning of the worm with the central axis of the chamber 106 is facilitated.

The actuator assembly 50 of the tuning device 34 includes a spacer 116 (FIG. 3) having a cylindrical bore 118 and a generally hourglass shaped outer surface 120. A wave-type spring washer 124 is provided between the end of the spacer and a surface 126 on the handle 54. Upon tightening of a screw **130*a*, the pressure applied against the spring washer 124 by the handle 54 increases. During rotation of the handle 54, the spring washer rotates relative to an end surface 130 on the spacer 116. Therefore, increasing the pressure between the spring washer 126 and the surface 130 increases the resistance to turning movement of the handle. By adjusting the screw 130***a*, the amount of frictional or braking resistance to rotation of the handle 54 can be adjusted.

Tuning Devices Having Shiftable Pinion Gears

In the embodiment of the invention illustrated in FIGS. 3–5, the pinion gear 60 is mounted for rotation with the shaft 32 about their common central axis. Since the pinion gear 60 is supported on its opposite sides by the bearing surface 72 and the recess 84 in the housing cap 80, the spacing between the axis of rotation of the pinion gear 60 and the axis of rotation of the worm 64 cannot be adjusted. Due to an accumulation of tolerances in the making of the pinion gear 60 and worm 64 and the forming of the housing 52, it is desirable to be able to vary the relative positions of the axes about which the pinion and worm rotate.

In the embodiments of the invention illustrated in FIGS. 6 and 7 of the drawings, the position of the pinion gear is adjustable relative to the worm to enable the desired meshing relationship to be obtained between these two gears. Since the embodiments of the invention illustrated in FIGS. 6 and 7 are generally similar to the embodiment of the invention illustrated in FIGS. 3–5, the same reference numerals will be associated with the embodiments of the invention illustrated in FIGS. 6 and 7, the suffix letter *a* being added to the numerals associated with FIG. 6 and the suffix letter *b* being added to the numerals added to FIG. 7 in order to avoid confusion.

In the embodiment of the invention illustrated in FIG. 6, a pinion gear is movable toward and away from a worm 64*a* under the influence of the housing cap 80a which functions as a pinion gear adjustment member, a bearing member for rotatably supporting the pinion gear, and a closure for an opening to the pinion gear chamber. The housing cap 80*a* includes a slot 150 which is offset from a center 152 of the circular cap. The bearing projection 76*a* on the pinion gear extends into the slot 150. Since the center of the slot 150 is offset from the center 152 of the housing cap 80*a*, the center 154 of the bearing section 76*a* is also offset from the center of the cap 80*a*.

Upon rotation of the cap 80*a* about its central axis, the eccentric slot 150 is moved in such a manner as to shift the pinion gear sideways relative to the worm 64 to thereby vary the meshing relationship between the teeth of the two gears. Once the desired meshing relatonship has been obtained, the housing cap 80*a* is fixed against further rotation. It is contemplated that this will be accomplished by crimping the walls of the housing against the sides of the housing cap 80*a*.

Once the housing has been crimped against the housing cap 80a to hold it against rotation, the housing cap will hold the pinion gear against further sidewise movement so that the precise meshing relationship at which the pinion gear was set will be maintained during operation of the tuning device. By precisely setting the meshing relationship between the pinion gear and the worm 64*a*, all backlash between the gears can be eliminated and desired gear tooth pressure forces obtained to provide for smooth action of the tuning device. The elimination of the backlash between the pinion gear and worm gear 64a is particularly advantageous when the direction of operation of the tuning device is being reversed a plurality of times in order to alternately increase and decrease the tension of the associated string during fine tuning of the string. It should be noted that the elimination of the backlash between the pinion gear and the worm gear 64*a* has been obtained within the limits of good machining practice and the elimination of the buildup of dimensional tolerances.

In the embodiment of the invention illustrated in FIG. 7, the pinion gear 60*b* is shifted toward and away from the associated worm by a housing cap 80*b* in much the same manner as previously explained in connection with the embodiment of the invention illustrated in FIG. 6. However, the housing cap 80*b* is provided with a cylindrical recess 160 which receives the bearing section 76*b* on the pinion gear 60*b*. The cylindrical opening 160 has a central axis 162 which is offset from the central axis 164 of the housing cap 80*b* (see FIGS. 7 and 7a). Therefore upon rotation of the housing cap 80*b*, the cylindrical surface 160 moves the pinion gear 60*b* toward or away from the associated worm to adjust the meshing relationship between the two gears. Once the desired meshing relationship has been obtained, the housing is crimped to hold the cap 80*b* against further rotation. Of course, the cap 80*b* will then support the bearing section 76*b* and hold the pinion gear 60*b* against sidewise movement relative to the worm.

The cap 80*b*, like the cap 80*a* of FIG. 6, acts as an eccentric to enable the pinion gear 60*b* to be accurately positioned relative to the worm gear to eliminate all backlash between the worm and pinion gears. Since the cap 80*b* can be rotated in either a clockwise or counterclockwise direction to move the pinion gear toward and away from the worm gear, the meshing relationship between the worm and pinion gears can be adjusted to obtain a desired pressure between the gear teeth. Thus, by utilizing either the housing cap 80*a* or the housing cap 80*b*, the pinion gear can be accurately positioned relative to the associated worm gear. The housing caps 80*a* and 80*b* have slotted outer surfaces to facilitate rotating the caps. It should be noted that if desired, the crimping holding the caps 80*a* and 80*b* could be released and the caps adjusted to suit the preference of an individual musician or to compensate for wear after a period of use. Of course the caps 80*a* and 80*b* could be held by a means other than crimping the housing.

GEARING ARRANGEMENT OF FIG. 8

In the embodiments of the invention illustrated in FIGS. 1 through 7, the pinion gears have been provided with spur teeth having arcuate crest shaped in the manner illustrated in FIG. 4, and having minimum diameter portions disposed midway between opposite side surfaces of the pinion gear. In the embodiment of the invention illustrated in FIG. 8, the pinion gear is provided with spur teeth having crests with a minimum diameter point which is offset from the center of the gear. The meshing relationship between the worm and spur gear can be varied by varying the vertical position of the spur gear relative to the worm. Since the embodiment of the invention illustrated in FIG. 8 is generally similar to the embodiment of the invention illustrated in FIGS. 1–7, similar numerals will be utilized to designate similar components, the suffix letter *c* being associated with the numerals of FIG. 8 to avoid confusion.

The pinion gear 60*c* is advantageous formed with gear teeth having creast with a minimum diameter point which is offset from the center of the gear. Thus, in FIG. 8 a flat plane 234 contains the axis of rotation of the worm 64c and the low or minimum diameter points of the crests of each of the teeth of the pinion gear 60c. It should be noted that the flat plane 234 is offset from an axis 238 which is disposed midway between opposite side surfaces 240 and 242 of the pinion gear 60e. By forming of the pinion gear teeth in this manner, binding between the pinion gear 60c and worm gear 64c tends to be minimized.

The pinion gear 60c is formed with a cylindrical bearing section 76c which cooperates with a circular recess in a housing cap in the same manner as in which the cylindrical bearing section 76 of the pinion gear 60 of FIGS. 3 and 4 cooperates with the recess 84 in the housing cap 80. To increase the meshing relationship between the pinion gear 60c and the worm gear 64c, it is merely necessary to move the pinion gear 60c axially downwardly from the position shown in FIG. 8. Similarly, if the meshing relationship between the worm and pinion gears is to be decreased, it is merely necessary to move the pinion gear axially upwardly. A suitable threaded screw and locknut arrangement may be utilized to shift the pinion gear 60c relative to the worm 64c.

Friction Washer Mounting Arrangement of FIG. 9

In the embodiment of the invention illustrated in FIG. 3, the friction washer 124 is disposed between the handle 54 and spacer 116. In the embodiment of the invention illustrated in FIG. 9, the friction washer is disposed in a chamber between the spacer and the worm gear. Since the components of the embodiment of the invention illustrated in FIG. 9 are generally similar to the components of the embodiment of the invention illustrated in FIG. 3, similar numerals will be utilized to designate similar components, the suffix *d* being associated with the components of FIG. 9 to avoid confusion.

The spacer 116d circumscribes a shaft 66d connected with a worm gear 64d. A cylindrical chamber 186 is formed in the end of the spacer most closely adjacent to the housing 52d. The friction washer 124d is disposed within this chamber and abuts the end face of the worm gear 64d. Upon tightening of an associated screw, similar to the screw 130 of FIG. 3, the pressure between the friction washer and the spacer 116d is varied to thereby vary the amount of pressure required to turn the worm 64d.

Construction of the Tuning Device of FIGS. 10–11

In the embodiment of the invention illustrated in FIGS. 6 and 7, the pinion gears are shifted toward and away from the associated worm gears by eccentric openings in the housing caps 80a and 80b to vary the meshing relationship between the worm and pinion gears. In the embodiment of the invention illustrated in FIGS. 10–11, the meshing relationship between the worm and pinion gear is varied by shifting the worm toward and away from the pinion gear. Since the embodiment of FIGS. 10–11 has many components which are the same as the components of the embodiments of the invention illustrated in FIGS. 3–5, similar numerals will be utilized to designate similar components, the suffix letter *e* being associated with the components of FIGS. 10 through 11 in order to avoid confusion.

A pinion gear 60e (FIG. 10) is rotatably mounted in a cylindrical gear chamber 70e formed in a housing 52e. The pinion gear 60e, like the pinion gear 60 of FIG. 3, is fixedly connected to and mounted in a coaxial relationship with a tuning post or shaft 32. A mounting cap of the same construction as the mounting cap 80 of FIG. 4 is utilized to solidly support the cylindrical bearing projection 76e for rotation about the central axis of the pinion 60e. The pinion gear 60e engages helix 90e on a worm 64e. Upon rotation of a handle 54e the worm gear shaft 66e is rotated to rotate the worm 64e and effect rotation of the pinion gear 60e and associated string post or shaft.

An improved worm gear mounting arrangement 96e is provided at the outer end portion 94e of the worm 64e. The mounting arrangement 96e is of the same construction illustrated in FIG. 5 and includes an arcuate bearing surface 102e which engages a bearing surface 98e formed on the housing 52e. As was previously explained in connection with FIG. 5, the mounting arrangement 96e enables the worm to be shifted slightly in the gear chamber 106e and provides for an annular line of bearing contact between the arcuate bearing surface 102e on the end portion 94e of the worm and the bearing surface 98e formed on the housing 52e.

In accordance with a feature of this embodiment of the invention, an adjustment member 190 is provided to effect pivotal movement of the worm 64e about the mounting arrangement 96e in a direction either toward or away from the pinion gear 60e. In addition, the adjustment member 190 is effective to thereafter hold the worm 64e in the desired position relative to the pinion gear 60e. Thus by actuating the adjustment member 190, the meshing relationship between the teeth 88e of the pinion gear 60e and the helix 90e of the worm 64e can be varied to eliminate backlash and provide a desired gear tooth engagement pressure.

In the specific preferred embodiment of the invention illustrated in FIGS. 10 and 11, the adjustment member 190 takes the form of an eccentric which is rotatable in a cylindrical opening 194 leading to the worm gear chamber 106e. The cylindrical opening 194 is disposed in a coaxial relationship with the bearing surface 98e at the opposite end of the worm gear chamber 106e. A cylindrical bore 198 is formed in the adjustment member 190. The bore 198 is axially offset from a cylindrical outer surface 200 of the adjustment member 190.

When the adjustment member 190 is rotated in the cylindrical opening 194, the eccentric bore 198 is shifted relative to the axis of rotation of the pinion gear 60e by a distance equal to twice the distance which the center of the bore 198 is offset from the center of the cylindrical surface 200. This is perhaps best seen in FIG. 11 wherein the center of the cylindrical surface 200 is indicated by the numeral 202. The center of the bore 198 is indicated by the numeral 204. Upon rotation of the adjustment member 190 in a clockwise direction as viewed in FIG. 11, the center of the bore 198 will move in a clockwise direction about the center 202 of the cylindrical surface 200. As this occurs, the cylindrical bore will be displaced downwardly (as viewed in FIG. 11) in a direction away from the pinion gear 60e.

To facilitate movement of the worm 64e toward and away from the pinion gear 60e, the worm is provided with an arcuately curved bearing end portion 208 which is disposed within the cylindrical bore 198. When the position of the bore 198 shifts relative to the axis of rotation of the pinion gear 60e, the bearing portion 208 is also shifted, relative to the axis of the pinion gear 60e to thereby effect a pivoting or tilting movement of the worm gear 64e about the mounting arrangement 96e. This pivotal movement of the worm gear 64e about the mounting arrangement 96e is facilitated by the arcuate annular outer surface of the bearing section 208. This arcuate surface pivots relative to the cylinder inner surface of the bore 198 without binding as the worm gear pivots about the mounting arrangement 96e.

As the worm 64e pivots about the mounting arrangement 96e, the outer end portion of the worm shaft 66e and the handle 54e are also pivoted relative to the housing 52e and spacer 116e. To promote this relative movement between handle 54e and the adjustment member spacer 116e, the spacer 116e is provided with an arcuate end surface 214 having its center located at the center of the mounting arrangement 96e. Similarly, the handle 54e is provided with an arcuate surface 216 which engages the arcuate surface 214 and slides relative thereto upon pivotal movement of the worm 64e. Of course the surface 216 has a common center with the surface 214.

Once the meshing relationship between the worm 64e and pinion 60e has been adjusted to provide a desired meshing relationship in which is no backlash and binding between the gears, it is desirable that the adjustment member 190 be held in the position to which it has been rotated. Although this could be accomplished in many different ways, in the illustrated embodiment of the invention it is accomplished by providing an interference or force fit between the cylindrical exterior surface 200 of the adjustment member and the cylindrical inner surface 194 of the housing. Of course, if desired, other known locking arrangements could be utilized to further hold the adjustment member 190 against rotation.

It is contemplated that under certain circumstances it may be desirable to vary the meshing relationship between the worm 64e and pinion 60e after the tuning device has been assembled. This can be accomplished by merely rotating the adjustment member 190. To facilitate rotating the adjustment member 190 against the influence of the extremely tight interference fit between the surfaces 194 and 200 on the housing and adjustment member, one or more pairs of flats are provided on the outside of the adjustment member to enable it to be securely gripped with a wrench or similar tool. It should be noted that this subsequent adjustment of the meshing relationship between the worm 64e and pinion gear 60e is facilitated by the use of only the interference fit between the adjustment member 190 and the housing 52e to hold the adjustment member 190.

In the illustrated embodiment of the invention, the adjustment member 190 has been integrally formed with the spacer 116e. It is contemplated that the adjustment member could be formed as a separate member from the spacer. In fact the adjustment member would not have to project through the cylindrical opening 194 in the housing. When this construction is utilized it is contemplated that the adjustment member would be provided with a pair of holes or notches to be engaged by a suitable tool to rotate the adjustment member against the influence of an interference fit between the adjustment member and the housing. This construction has the advantage of isolating the adjustment member from rotational forces caused by rotating the handle 54e since the spacer would abut the housing 52e and would be ineffective to apply rotational forces against the adjustment member.

The spacer 116e cooperates with the housing 52e and handle 54e to securely hold the worm 64e against axial movement. Thus, a solid metal-to-metal series of abutting surfaces are clamped together by the retaining screw 130e to press the bearing surface 120e on the worm gear 64e against the bearing surface 98e on the housing.

Although the various tuning devices disclosed in FIGS. 3–11 are advantageously utilized with a musical instrument having the construction illustrated in FIG. 1, the tuning devices could be utilized with musical instruments of many different constructions. It should also be understood that the housing constructions could differ from the specific preferred housing constructions illustrated in the drawings.

Having described specific preferred embodiments of the invention, the following is claimed:

1. A device for use in tuning the strings of a stringed musical instrument, said device comprising a rotatable shaft adapted to be connected with a string of the musical instrument, a pinion gear connected with said shaft for rotation therewith about a common central axis, a rotatable worm gear disposed in meshing engagement with said pinion gear, fixed surface means disposed in a predetermined position relative to the central axis of said worm gear for rotatably supporting one side portion of said pinion gear, movable surface means for rotatably supporting another side portion of said pinion gear, means for rotating said worm gear about its central axis to effect rotation of said pinion gear and shaft about their common central axis, and adjustment means for moving said movable surface means relative to said fixed surface means to move said pinion gear and vary the meshing relationship between said pinion and worm gears.

2. A device as set forth in claim 1 wherein said adjustment means includes an adjustment member having a circular outer surface, said movable surface means being disposed within said adjustment member and having a circular cross section with a center which is offset from the center of said circular outer surface, said adjustment member being rotatable relative to said pinion gear to effect movement of said pinion gear in a direction transverse to the central axis of said worm gear.

3. A device as set forth in claim 2 wherein said fixed surface means has a circular cross section with a center which is coaxial with the center of said circular outer surface of said adjustment member.

4. A device as set forth in claim 1 wherein said fixed surface means supports said one side portion of said pinion gear for pivotal movement about a pivot axis extending transversely to the central axis of said pinion gear, said adjustment means being effective to move said movable surface means and effect pivotal movement of said pinion gear about said transverse axis.

5. A device for use in tuning the strings of a musical instrument, said device comprising a rotatable pinion gear having a body with a circular array of teeth disposed thereon, a shaft extending outwardly from a first side of said pinion gear body and disposed in a coaxial relationship with said circular array of teeth, said shaft having an outer end portion adapted to be connected with a string of the musical instrument, a rotatable worm gear having a portion disposed in meshing engagement with said pinion gear, means for rotating said worm gear about its central axis to effect rotation of said pinion gear and shaft, housing means for at least partially enclosing said worm and pinion gears, and bearing means for supporting said worm gear for rotation about its central axis, said bearing means including a first annular bearing surface connected with said worm gear for rotation therewith and a second annular bearing surface connected with said housing, said first and second annular bearing surfaces having different radial cross-sectional configurations to provide a circular line of contact between said bearing surfaces.

6. An apparatus as set forth in claim 5 further including means for moving said worm gear toward and away from said pinion gear to vary the meshing relationship therebetween, said first and second bearing surfaces being effective to maintain said circular line of contact during movement of said worm gear toward and away from said pinion gear.

7. A device for use in tuning the strings of a stringed musical instrument, said device comprising a rotatable shaft adapted to be connected with a string of the musical instrument, a pinion gear connected with said shaft for rotation therewith about the central axis of said shaft, said shaft extending outwardly from one side of said pinion gear, a rotatable worm gear disposed in meshing engagement with said pinion gear, means for rotating said worm gear about its central axis to effect rotation of said pinion gear and shaft about the central axis of the shaft, and adjustment means for moving one of said gears toward and away from the other of said gears to an operating position in which said gears have a desired meshing relationship and for holding said one gear in said operating position during rotation of said gears, said adjustment means being connected with a side of said pinion gear opposite from said one side and being operable to move said pinion gear toward and away from said worm gear.

8. A device for use in tuning the strings of a musical instrument, said device comprising a rotatable pinion gear having a body with a circular array of teeth disposed thereon, said pinion gear teeth having arcuate crests each of which curves inwardly from axially outer end portions of a tooth to a point of minimum diameter, a shaft extending outwardly from a first side of said pinion gear body and disposed in a coaxial relationship with said circular array of teeth, said shaft having an outer end portion adapted to be connected with a string of the musical instrument, a bearing section extending outwardly from a second side of said pinion gear body opposite from said first side and disposed in a coaxial relationship with said shaft, said bearing section having a circular cross-sectional configuration, a rotatable worm gear having a portion disposed in meshing engagement with said pinion gear, said points of minimum diameter of each of said pinion gear teeth disposed closer to one of said sides of said pinion gear body than the other in a common plane which contains the axis of rotation of said worm gear, means for rotating said worm gear about its central axis to effect rotation of said pinion gear and shaft, housing means for at least partially enclosing said worm and pinion gears, said housing means including wall means for defining a chamber circumscribing said pinion gear, said wall means defining a first chamber opening through which said shaft extends and a second chamber opening through which said pinion is inserted into said chamber, and cap means for closing said second chamber opening and for engaging said bearing section to at least partially support said pinion gear for rotation upon rotation of said worm gear, said cap means including surface means defining a recess for receiving said bearing section.

9. A device as set forth in claim 8 wherein said recess in said cap means has a circular cross-sectional configuration.

10. A device for use in tuning the strings of a musical instrument, said device comprising a rotatable pinion gear having a body with a circular array of teeth disposed thereon, a shaft extending outwardly from a first side of said pinion gear body and disposed in coaxial relationship with said circular array of teeth, said shaft having an outer end portion adapted to be connected with a string of the musical instrument, a bearing section extending outwardly from a second side of said pinion gear body opposite from said first side and disposed in a coaxial relationship with said shaft, said bearing section having a circular cross-sectional configuration, a rotatable worm gear having a portion disposed in meshing engagement with said pinion gear, means for rotating said worm gear about its central axis to effect rotation of said pinion gear and shaft, housing means for at least partially enclosing said worm and pinion gears, said housing means including wall means for defining a chamber circumscribing said pinion gear, said wall means defining a first chamber opening through which said shaft extends and a second chamber opening through which said pinion is inserted into said chamber, and cap means for closing said second chamber opening and for engaging said bearing section to at least partially support said pinion gear for rotation upon rotation of said worm gear, said cap means including surface means defining a recess for receiving said bearing section, said surface means being movable toward and away from said worm gear to vary the meshing relationship between said worm and pinion gears.

11. A device for use in tuning the strings of a stringed musical instrument, said device comprising a rotatable shaft adapted to be connected with a string of the musical instrument, a pinion gear connected with said shaft for rotation therewith about the central axis of said shaft, a rotatable worm gear having a central portion disposed in meshing engagement with said pinion gear and a pair of opposite end portions extending outwardly from said central portion, means for rotating said worm gear about its central axis to effect rotation of said pinion gear and shaft about the central axis of the shaft, and adjustment means for moving one of said gears toward and away from the other of said gears to an operating position in which said gears have a desired meshing relationship and for holding said one gear in said operating position during rotation of said gears, said adjustment means being connected with one of said end portions of said worm gear and being operable to move said one end portion of said worm gear relative to the other end portion of said worm gear to move the central portion of said worm gear toward and away from said pinion gear, said adjustment means including an eccentric having a surface which is offset from the axis of rotation of said one gear, said eccentric being rotatable in a first direction about the axis of rotation of said one gear to effect movement of said one gear toward said other gear, said eccentric being rotatable in a second direction about the axis of rotation of said one gear to effect movement of said one gear away from said other gear.

12. A device as set forth in claim 11 further including friction means for applying a braking force resisting rotation of said worm about its axis of rotation and means for varying the braking force to thereby vary the force required to rotate worm gear about its axis of rotation.

13. A device for use in tuning the strings of a stringed musical instrument, said device comprising a rotatable shaft adapted to be connected with a string of the musical instrument, a pinion gear connected with said shaft for rotation therewith about a common central axis, a rotatable worm gear having a portion disposed in meshing engagement with said pinion gear, fixed surface means disposed in a predetermined position relative to the central axis of said pinion gear for rotatably supporting one end portion of said worm gear for pivotal movement about an axis extending transversely to the central axis of said worm gear, movable surface means for rotatably supporting another end portion of said worm gear, means for rotating said worm gear about its central axis to effect rotation of said pinion gear and shaft about their common central axis, and adjustment means for moving said movable surface means relative to said fixed surface means and the central axis of said pinion gear to pivot said worm gear about said transverse axis and vary the meshing relationship between said pinion and worm gears, said adjustment means including an adjustment member having a circular outer surface, said movable surface means being disposed within said adjustment member and having a circular cross section with a center which is offset from the center of said circular outer surface, said adjustment member being rotatable relative to said worm gear to effect sidewise movement of said worm gear.

14. A device as set forth in claim 13 further including a housing which at least partially encloses said pinion and worm gears, said fixed surface means being fixedly disposed on said housing, said movable surface means being connected with and movable relative to said housing.

15. A device as set forth in claim 13 wherein said fixed surface means has a circular cross section with a center which is coaxial with the center of said circular outer surface of said adjustment member.

16. A device for use in tuning the strings of a stringed musical instrument, said device comprising a rotatable shaft adapted to be connected with a string of the musical instrument, a pinion gear connected with said shaft for rotation therewith about the central axis of said shaft, a rotatable worm gear disposed in meshing engagement with said pinion gear, means for rotating said worm gear about its central axis to effect rotation of said pinion gear and shaft about the central axis of the shaft, bearing surface means for supporting one of said gears for pivotal movement about a pivot axis extending transversely to the axis of rotation of said one gear, and adjustment means for moving said one of said gears toward and away from the other of said gears to an operating position in which said gears have a desired meshing relationship and for holding said one gear in said operating position during rotation of said gears, said adjustment means including adjustment surface means for pivoting said one gear about said pivot axis to vary the meshing relationship between said gears, for locking said one gear against movement from said operating position in a direction toward said other gear, and for locking said one gear against movement from said operating position in a direction away from said other gear to positively maintain the spatial relationship between axes of rotation of said gears constant during rotation of said gears.

17. A device as set forth in claim 16 wherein said adjustment surface means includes an eccentric having a surface which is offset from the axis of rotation of said one gear, said eccentric being rotatable in a first direction about the axis of rotation of said one gear to effect movement of said one gear toward said other gear, said eccentric being rotatable in a second direction about the axis of rotation of said one gear to effect movement of said one gear away from said other gear.

18. A device for use in tuning the strings of a stringed musical instrument, said device comprising a rotatable shaft adapted to be connected with a string of the musical instrument, a pinion gear connected with said shaft for rotation therewith about the central axis of said shaft, said shaft extending outwardly from one side of said pinion gear, a rotatable worm gear disposed in meshing engagement with said pinion gear, means for rotating said worm gear about its central axis to effect rotation of said pinion gear and shaft about the central axis of the shaft, and adjustment means for moving one of said gears toward and away from the other of said gears to an operating position in which said gears have a desired meshing relationship and for holding said one gear in said operating position during rotation of said gears, said adjustment means including adjustment surface means for locking said one gear against movement from said operating position in a directiontoward said other gear and for locking said one gear against movement from said operating position in a direction away from said other gear to positively maintain the spatial relationship between axes of rotation of said gears constant during rotation of said gears, said adjustment surface means being connected with a side of said pinion gear opposite from said one side and being operable to move said pinion gear toward and away from said worm gear.

19. A device for use in tuning the strings of a stringed musical instrument, said device comprising a rotatable shaft adapted to be connected with a string of the musical instrument, a pinion gear connected with said shaft for rotation therewith about the central axis of said shaft, a rotatable worm gear disposed in meshing engagement with said pinion gear, said worm gear including a central portion disposed in meshing engagement with said pinion gear and a pair of opposite end portions extending outwardly from said central portion, means for rotating said worm gear about its central axis to effect rotation of said pinion gear and shaft about the central axis of the shaft, and adjustment means for moving one of said gears toward and away from the other of said gears to an operating position in which said gears have a desired meshing relationship and for holding said one gear in said operating position during rotation of said gears, said adjustment means including adjustment surface means for locking said one gear against movement from said operating position in a direction toward said other gear and for locking said one gear against movement from said operating position in a direction away from said other gear to positively maintain the spatial relationship between axes of rotation of said gears constant during rotation of said gears, said adjustment surface means being connected with one of said end portions of said worm gear and being movable in opposite directions relative to said worm gear to move said one end portion of said worm gear relative to the other end portion of said worm gear and to move the central portion of said worm gear toward and away from said pinion gear.

20. A device as set forth in claim 19 further including friction means for applying a braking force resisting rotation of said worm about its axis of rotation and means for varying the braking force to thereby vary the force required to rotate worm gear about its axis of rotation.

21. A device for use in tuning the strings of a stringed musical instrument, said device comprising a rotatable shaft adapted to be connected with a string of the musical instrument, a pinion gear connected with said shaft for rotation therewith about the central axis of said shaft, said shaft extending outwardly from one side of said pinion gear, a rotatable worm gear disposed in meshing engagement with said pinion gear, means for rotating said worm gear about its central axis to effect rotation of said pinion gear and shaft about the central axis of the shaft, and adjustment means for moving one of said gears toward and away from the other of said gears to an operating position in which said gears have a desired meshing relationship and for holding said one gear in said operating position during rotation of said gears, said adjustment means including adjustment surface means connected with a side of said pinion gear opposite from said one side and movable in one direction to apply a force to said one gear in a direction toward said other gear, said adjustment surface means being movable in a direction opposite from said one direction to apply a force to said one gear in a direction away from said other gear.

22. A device as set forth in claim 21 wherein said adjustment surface means includes an eccentric having a surface which is offset from the axis of rotation of said pinion gear, said eccentric being rotatable in the one direction to effect movement of said pinion gear toward said worm gear, said eccentric being rotatable in the other direction to effect movment of said pinion gear away from said worm gear.

23. A device for use in tuning the strings of a stringed musical instrument, said device comprising a rotatable shaft adapted to be connected with a string of the musical instrument, a pinion gear connected with said shaft for rotation therewith about the central axis of said shaft, a rotatable worm gear disposed in meshing engagement with said pinion gear, said worm gear having a central portion disposed in meshing engagement with said pinion gear and a pair of opposite end portions extending outwardly from said central portion, means for rotating said worm gear about its central axis to effect rotation of said pinion gear and shaft about the central axis of the shaft, and adjustment means for moving one of said gears toward and away from the other of said gears to an operating position in which said gears have a desired meshing relationship and for holding said one gear in said operating position during rotation of said gears, said adjustment means including adjustment surface means movable in one direction to apply a force to said one gear in a direction toward said other gear, said adjustment surface means being movable in a direction opposite from said one direction to apply a force to said one gear in a direction away from said other gear, said adjustment surface means being connected with one of said end portions of said worm gear and being movable to shift said one end portion of said worm gear relative to the other end portion of said worm gear to move the central portion of said worm gear relative to said pinion gear.

24. A device for use in tuning the strings of a stringed musical instrument, said device comprising a rotatable shaft adapted to be connected with a string of the musical instrument, a pinion gear connected with said shaft for rotation therewith about the central axis of said pinion gear, first bearing means having a circular cross sectional configuration for at least partially supporting said pinion gear for rotation about the central axis of said pinion gear, a rotatable worm gear disposed in meshing engagement with said pinion gear, second bearing means having a circular cross sectional configuration for at least partially supporting said worm gear for rotation about its central axis, means for rotating said worm gear about its central axis to effect rotation of said pinion gear and shaft, and adjustment means for moving one of said bearing means and the associated one of said gears toward and away from the other of said gears to vary the angular relationship between the central axes of said gears and the meshing relationship between said gears.

25. A device for use in tuning the strings of a stringed musical instrument, said device comprising a rotatable shaft adapted to be connected with a string of the musical instrument, a pinion gear connected with said shaft for rotation therewith about the central axis of said shaft, a rotatable worm gear disposed in meshing engagement with said pinion gear, means for rotating said worm gear about its central axis to effect rotation of said pinion gear and shaft about the central axis of the shaft, surface means for supporting one of said gears for pivotal movement about a pivot axis extending transversely to the axis of rotation of said one gear, and adjustment means for moving one of said gears toward and away from the other of said gears to an operating position in which said gears have a desired meshing relationship and for holding said one gear in said operating position during rotation of said gears, said adjustment means including an eccentric having a surface which is offset from the axis of rotation of said one gear, said eccentric being rotatable in a first direction about the axis of rotation of said one gear to effect pivotal movement of said one gear about said pivot axis in a direction toward said other gear, said eccentric being rotatable in a second direction about the axis of rotation of said one gear to effect pivotal movement of said one gear about said pivot axis in a direction away from said other gear.

26. A device as set forth in claim 25 wherein said shaft extends outwardly from one side of said pinion gear, said eccentric being connected with a side of said pinion gear opposite from said one side and being operable to move said pinion gear toward and away from said worm gear.

27. A device as set forth in claim 25 wherein said worm gear includes a central portion disposed in meshing engagement with said pinion gear and a pair of opposite end portions extending outwardly from said central portion, said eccentric being connected with one of said end portions of said worm gear and being operable to pivot said one end portion of said worm gear relative to the other end portion of said worm gear to move the central portion of said worm gear toward and away from said pinion gear.

28. A device for use in tuning the strings of a musical instrument, said device comprising a rotatable pinion gear having a body with a circular array of teeth disposed thereon, a shaft extending outwardly from a first side of said pinion gear body and disposed in a coaxial relationship with said circular array of teeth, said shaft having an outer end portion adapted to be connected with a string of the musical instrument, a bearing section extending outwardly from a second side of said pinion gear body opposite from said first side and disposed in a coaxial relationship with said shaft, said bearing section having a circular cross-sectional configuration, a rotatable worm gear having a portion disposed in meshing engagement with said pinion gear, means connected with one end of said worm gear for rotating said worm gear about its central axis to effect rotation of said pinion gear and shaft, a one-piece housing for at least partially enclosing said worm and pinion gears, said housing including wall means for defining a first chamber enclosing said pinion gear, said wall means defining a first chamber opening through which said shaft extends and a second chamber opening through which said pinion is inserted into said chamber, a circular cap connected with said wall means and closing said second chamber opening, said cap including surface means defining a recess in said cap for receiving said bearing section to at least partially support said pinion gear for rotation upon rotation of said worm gear, said cap being connected with said one-piece housing to hold said pinion gear against axial movement, said wall means of said one-piece housing defining a second chamber enclosing said worm gear, said first and second chambers being connected with each other at a third chamber opening formed in said wall means, at least one of said gears extending through said third chamber opening to provide for meshing engagement between said gears, said wall means defining a fourth chamber opening through which said means for rotating said worm gear extends and a fifth chamber opening disposed in a coaxial relationship with said fourth chamber opening, and a bearing end portion fixedly connected with an end of said worm gear opposite from said one end for rotatably supporting the opposite end of said worm gear, said bearing end portion of said worm gear extending across and completely blocking said fifth chamber opening.

29. A device as set forth in claim 28 wherein said circular cap has a central axis which is offset from the central axis of said recess in said cap, said cap being rotatable about its central axis to effect movement of said pinion gear relative to said worm gear and thereby vary the meshing relationship between said pinion and worm gears.

* * * * *

UNITED STATES PATENT OFFICE

CERTIFICATE OF CORRECTION

Patent No. 4,014,239 Dated March 29, 1977

Inventor(s) Robert J. Spercel

It is certified that error appears in the above-identified patent and that said Letters Patent are hereby corrected as shown below:

Column 13, line 53 after "teeth" add --being--.

Column 16, line 29 change "directiontoward" to --direction toward--.

Signed and Sealed this

Fourteenth Day of June 1977

[SEAL]

*Attest:*

RUTH C. MASON
*Attesting Officer*

C. MARSHALL DANN
*Commissioner of Patents and Trademarks*